US011808102B1

(12) United States Patent
Roberts et al.

(10) Patent No.: US 11,808,102 B1
(45) Date of Patent: Nov. 7, 2023

(54) DISSOLVABLE FRAC PLUG HOUSING TRACER

(71) Applicant: Vertice Oil Tools Inc., Stafford, TX (US)

(72) Inventors: Tyler Roberts, Houston, TX (US); Ben Weber, Houston, TX (US)

(73) Assignee: Vertice Oil Tools, Inc., Stafford, TX (US)

( * ) Notice: Subject to any disclaimer, the term of this patent is extended or adjusted under 35 U.S.C. 154(b) by 104 days.

(21) Appl. No.: 17/490,740

(22) Filed: Sep. 30, 2021

Related U.S. Application Data

(63) Continuation of application No. 16/716,338, filed on Dec. 16, 2019, now abandoned.

(60) Provisional application No. 62/820,202, filed on Mar. 18, 2019.

(51) Int. Cl.

| | |
|---|---|
| ***E21B 33/12*** | (2006.01) |
| ***E21B 29/02*** | (2006.01) |
| ***E21B 47/11*** | (2012.01) |
| ***E21B 47/002*** | (2012.01) |
| ***E21B 47/00*** | (2012.01) |

(52) U.S. Cl.
CPC ..... *E21B 33/12* (2013.01); *E21B 29/02* (2013.01); *E21B 47/00* (2013.01); *E21B 47/002* (2020.05); *E21B 47/11* (2020.05)

(58) Field of Classification Search
CPC ..... E21B 33/12; E21B 29/02; E21B 47/00; E21B 47/006; E21B 47/11; E21B 47/111
See application file for complete search history.

(56) References Cited

U.S. PATENT DOCUMENTS

| | | | | |
|---|---|---|---|---|
| 10,947,809 | B2 * | 3/2021 | Subbaraman | E21B 33/1208 |
| 2018/0087369 | A1 * | 3/2018 | Sherman | G01N 33/24 |
| 2018/0306027 | A1 * | 10/2018 | Sherman | E21B 29/02 |

* cited by examiner

*Primary Examiner* — Catherine Loikith
(74) *Attorney, Agent, or Firm* — PIERSON INTELLECTUAL PROPERTY LLC

(57) ABSTRACT

A dissolvable frac plug with an internal chamber surrounded by an external wall with the chamber containing a tracer compound in an amount sufficient to be observed from water or other wellbore fluids when released. The tracer compound is released from the chamber as a portion or portions of the external wall dissolves due to contact with water or other wellbore fluids. The released tracer compound can be monitored from the water or other wellbore fluids.

19 Claims, 6 Drawing Sheets

DISSOLVABLE FRAC PLUG HOUSING TRACER

CROSS-REFERENCE TO RELATED APPLICATION

This application is a continuation of U.S. application Ser. No.: 16/716,338 filed Dec. 16, 2019, which claims the benefit of priority to U.S. application Ser. No. 62/820,202, filed Mar. 18, 2019, each of which is incorporated herein by reference in its entirety.

BACKGROUND

The present invention relates to a dissolvable frac plug housing a tracer compound that can be identified from water or other wellbore fluids when the plug is to be dissolved or removed from the wellbore.

Downhole plugs are used in the extraction industry to seal off portions of wellbores for a variety of reasons. Portions of a wellbore may be sealed off to assist in the collection of hydrocarbons, to create pressure, or isolate zones of the well, for example. After the operation involving the downhole plug is complete, the plug must be removed from the wellbore or otherwise disposed of. Typically, dissolvable plugs are made in part or whole of material that dissolves the plugs when they come into contact with certain elements such as water or other wellbore fluids. After the plug is sufficiently dissolved, its remnants may be more easily retrieved for disposal.

Various means of identifying dissolved downhole plugs have been practiced over the years. Traditionally, an operator pumps tracers into the completion fluid at each stage during the frac operation. Such operations, however, can be complex, time-consuming, and expensive.

Housing tracer materials in dissolvable plugs has been hereby proposed to remedy the disadvantages of traditional methods and facilitate identification of plugs that do not produce. The simplicity of housing tracer materials in dissolvable plugs allows real-time data analysis without any change to typical frac operations. For example, in a plug and perf well, the well typically has around 35 to 50 fracturing stages, which means there would be around 35 to 50 frac plugs set inside the well at different depths. Therefore, with the traditional method, it would be practically difficult for the end user to pump tracers into the completion fluid for multiple fracturing stages.

There is, therefore, a need for a dissolvable frac plug that can update the status of dissolution of plugs for each fracturing stage without the operator from location that normally mixes tracers with the completion fluid during pumping operations. In particular, there is a need for dissolvable frac plugs that impregnate different kinds of tracer materials during the frac job and release and expose them to water or other wellbore fluids once the plugs dissolve. There is a further need for tracer materials that can readily make chemical change in the fluids.

SUMMARY OF THE INVENTION

According to embodiments of the present invention, a dissolvable frac plug is disclosed. The dissolvable frac plug comprises one or a plurality of internal chambers surrounded by an external wall with at least one chamber containing a tracer compound in an amount sufficient to be observed from water or other wellbore fluids when the tracer compound is released to the fluids. As a portion or portions of the external wall dissolve due to contact with water or other wellbore fluids, the tracer compound is released to the fluids and flows back to land surface so that the end user on the surface can monitor the status of dissolution of plugs for each fracturing stage.

Preferably, one or a plurality of internal chambers are provided, at least one, some or all of which further contain a dry powder. Alternatively, one or some of the chambers contain the dry powder and one or some of the chambers contain one or more different chemical components that combine with the powder to create a corrosive solution or environment.

In some embodiments, the internal chamber includes one or more cylindrical chambers that surround the dissolvable frac plug. These can be arranged in a variety of configurations with the size of chambers varying depending upon the size of the plug and the speed of dissolution desired, as well as to accommodate the tracer compound.

In certain desirable embodiments, the external wall includes one or more openings to allow filling or packing of the internal chamber with a tracer compound, a dry powder and/or, if present, other components. In some of these embodiments, the one or more openings are closed by a curable compound that seals the internal chamber(s) and prevents escape of the tracer compound, the dry powder and/or the other components.

In a preferred embodiment, the dry powder is sodium bisulfate or aluminum chloride or both and the external wall is made of a dissolvable aluminum or magnesium metal or alloy. Generally, the external wall is configured to dissolve in water or other wellbore fluids within eight and twelve hours, and then the tracer compound is released to water or other wellbore fluids. Plural internal chambers can be provided, one or more of which contain the tracer compound, one or more of which contain a dry powder and one or more of which contain one or more of other chemical components that combine with the powder to create a corrosive environment. The dry powder materials can be provided in the same chamber or in different, adjacent chambers. Placing different dry powders in different chambers is necessary when the dry powders are reactive with each other. In that situation, they can react after being released to create a more corrosive environment that causes dissolution of the plug.

In a preferred embodiment, the tracer compound is in a form of powder, capsule or solution. Tracer compounds are categorized into three groups: oil soluble tracers, water soluble tracers, and gas soluble tracers. Typical oil soluble tracers are halogenated hydrocarbons. The halogenated hydrocarbons may include, but not be limited to, fluorobenzoates, chlorobenzoates and bromobenzenes. Typical water soluble tracers are halogenated salts. The halogenated salts may include, but not be limited to, sulfonic acids, fluorobenzoic acids and chlorobenzoic acids. Typical gas soluble tracers are perfluorinated compounds. The perfluorinated compounds may include, but not be limited to, perfluorinated compounds such as mercaptan, nitrogen, perfluoromethylcyclopentanes and perfluoromethylcyclohexanes.

In some embodiments, multiple dissolvable frac plugs, for example, from 35 to 50 dissolvable frac plugs can be provided, each of the dissolvable plugs containing a different kind of tracer compound to be released to water or other wellbore fluids and flow back to land surface, which allows the end user on the surface to identify which frac plug dissolves and where the flow originates from due to different and unique chemical features of each tracer compound.

An additional embodiment of the present invention includes a method of tracking dissolution of a dissolvable frac plug. The method comprises providing a dissolvable frac plug comprising at least one internal chamber surrounded by an external wall with the chamber containing a tracer compound in an amount sufficient to be observed from water or other wellbore fluids when released to the fluids, delivering the dissolvable frac plug into a wellbore wherein water or other wellbore fluids are present downstream of the plug, initially dissolving the dissolvable frac plug by contact with the water or other wellbore fluids over a certain period of time to at least dissolve a portion or portions of the external wall and expose at least a portion of one or some of the internal chambers, and releasing the tracer compound from the internal chamber into the water or other wellbore fluids; and identifying the released tracer compound from the water or other wellbore fluids.

BRIEF DESCRIPTION OF THE DRAWINGS

Various features of examples and embodiments in accordance with the principles described herein may be more readily understood with reference to the following detailed description taken in conjunction with the accompanying drawings, where like reference numerals designate like structural elements, and in which.

DETAILED DESCRIPTION OF THE INVENTION

The present system and method will be described in connection with the figures, it being understood that the description and figures are for illustrative, non-limiting purposes.

Embodiments of the present invention disclose a dissolvable downhole tool in particular as a frac plug. The dissolvable downhole tool comprises an internal chamber containing one or more tracer compounds to be released to certain downhole fluids such as water or other wellbore fluids and flow back to land surface to update the status of dissolution of the downhole tool to the end user on the surface. The compounds are released in the downhole environment after an external wall of the internal chamber is dissolved from prolonged contact with the downhole fluids.

Figure 1A:
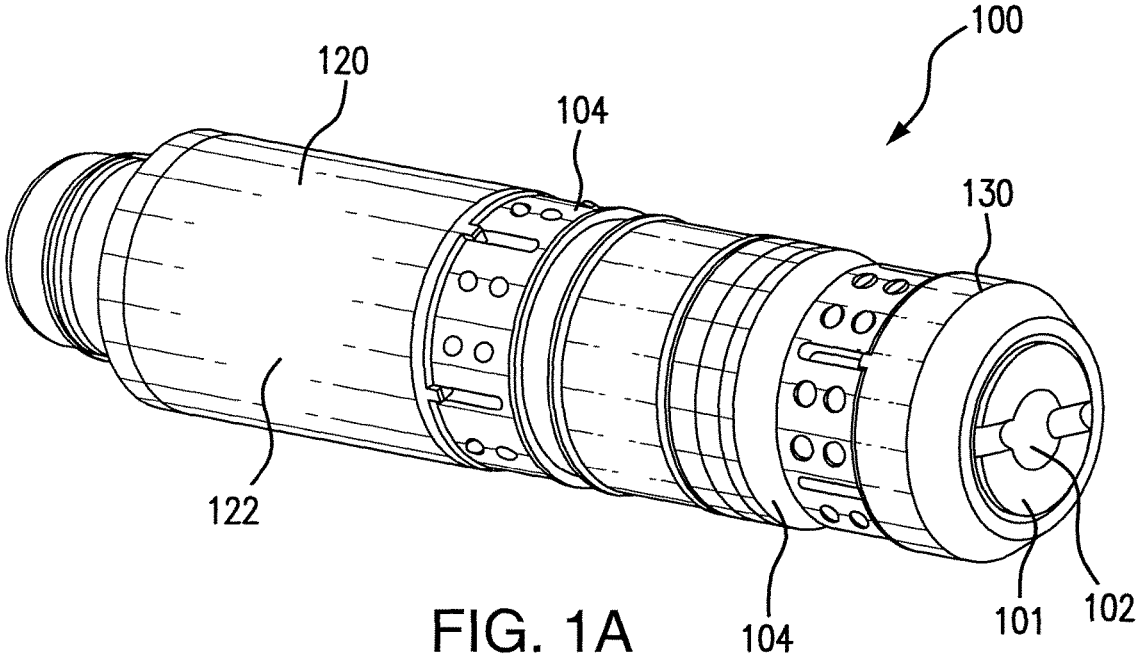
FIG. 1A illustrates a perspective view of a dissolvable frac plug comprising an internal chamber near or at the upper portion of the plug, according to an embodiment consistent with the principles described herein.
Figure 1B:
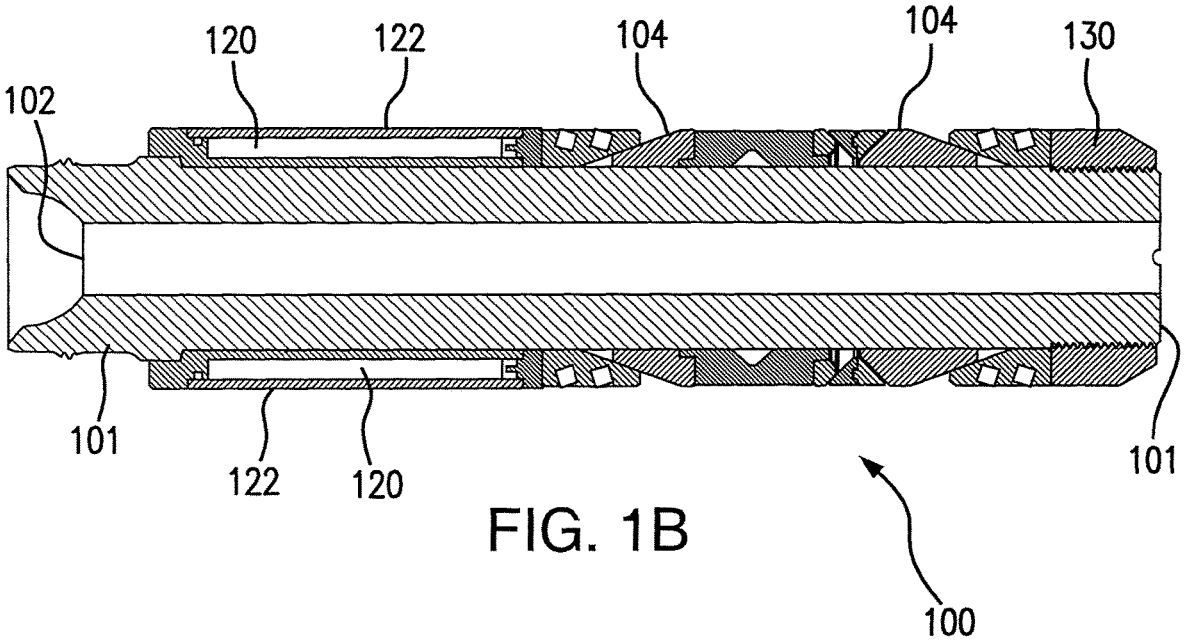
FIG. 1B illustrates a cross-sectional view of a dissolvable frac plug comprising an internal chamber near or at the upper portion of the plug, according to an embodiment of the principles described herein.

FIG. 1A illustrates a perspective view of a dissolvable frac plug 100, according to an embodiment consistent with the principles described herein. FIG. 1B illustrates a cross-sectional view of a dissolvable frac plug 100, according to an embodiment consistent with the principles described herein. The dissolvable frac plug 100 has a generally tubular elongated shape suitable for deployment into a wellbore. The dissolvable frac plug 100 may comprise various sections depending on its type and construction. For example, in the embodiment illustrated in FIGS. 1A and 1B, the dissolvable frac plug 100 comprises a hollow mandrel core 101 that runs the length of the tool. The mandrel core 101 has an axial flowbore 102 running therethrough. Portions of the mandrel 101 are encased by various radial structures 104 including for example, push ring assemblies, slider ring, upper and lower sup assemblies, and upper and lower cones. In the bottom portion of the dissolvable plug 100, the bottom portion of the mandrel core 101 may be partially enclosed by a concentric structure called a bottom cap 130. In the embodiment of FIGS. 1A and 1B, the bottom cap 130 is threaded for fastening to the bottom portion of the mandrel core 101. In some embodiments, the radial structures 104 are integrally formed with the mandrel core 101. In other embodiments, the radial structure 104 may be secured to the mandrel core 101 using various fastening means.

The dissolvable frac plug 100 may be constructed with a variety of materials. In some embodiments, the dissolvable frac plug may comprise material selected or designed for withstanding downhole conditions. Such material may include insoluble metals or alloys including titanium, copper, iron, and combinations thereof. Suitable metals and alloys may also be blended to other material to impart desirable properties to relevant parts of the dissolvable frac plug 100, such as increased strength or resistance to a certain downhole conditions.

Further, at least part of the dissolvable frac plug 100 is fabricated with material that can dissolve under certain conditions. Such materials may lose structural integrity, disintegrate, and even become soluble over time as they come in contact with or are immersed in other materials or compounds. In particular, the dissolvable frac plug 100, or portion of the dissolvable frac plug 100, may be built with material that reacts with and is degraded by exposure to downhole fluids such as water, brine, injection fluids, production fluids, drilling fluids, or various combinations thereof.

The dissolvable frac plug 100 further comprises an internal chamber 120. In the embodiment illustrated in FIGS. 1A and 1B, the internal chamber 120 of the dissolvable frac plug 100 is a concentric radial enclosure that surrounds a portion of the length of the mandrel core 101. In this embodiment, the internal chamber 120 is located near an upper end of the dissolvable frac plug 100, and extends down to between a third and a half of the length of the dissolvable frac plug 100. In other embodiments, the internal chamber 120 may be formed in a different location of the dissolvable frac plug 120. Further, the internal chamber 120 may have any of a variety of shapes. For example, the internal chamber 120 may have a rectangular or box shape. The internal chamber 120 may also have a cylindrical shape or even a spherical shape, in some embodiments. Preferably, at least one wall of the internal chamber is an external wall 122 of the dissolvable frag plug 100 that is exposed to the downhole environment, including the downhole fluids mentioned herein. In some embodiments, the external wall 122 of the internal chamber 120 is made of a dissolvable material that may react with said downhole fluids. The external wall 122 may thus be a component of the dissolvable portion of the dissolvable frac plug 100.

The internal chamber 120 serves to impregnate one or more of tracer or dye compounds in an amount (e.g., from about 10 mg to about 50 mg, from about 15 mg to about 45 mg, from about 20 mg to about 40 mg, or from about 25 mg to about 35 mg) sufficient to be observed from water or other wellbore fluids when released to the fluids. The tracer or dye compounds may come in any of a variety of forms. For example, the tracer or dye compounds may be a solid. It can be in a form of powder. In preferred embodiments, tracer compounds are categorized into three groups: oil soluble tracers, water soluble tracers, and gas soluble tracers. Typical oil soluble tracers are halogenated hydrocarbons. The halogenated hydrocarbons may include, but not be limited to, fluorobenzoates, chlorobenzoates and bromobenzenes. Typical water soluble tracers are halogenated salts. The halogenated salts may include, but not be limited to, sulfonic acids, fluorobenzoic acids and chlorobenzoic acids. Typical gas soluble tracers are perfluorinated compounds. The perfluorinated compounds may include, but not be limited to, perfluorinated compounds such as mercaptan, nitrogen, perfluoromethylcyclopentanes and perfluoromethylcyclohexanes. In some embodiments, the tracer or dye compounds may be packaged in a small water soluble pill, packet, pod or bag to separate it from the corrosive compound and, if present, one or more different chemical components. In other embodiments, the tracer compound can be mixed or housed with the corrosive compound and, if present, one or more different chemical components in at least one, some or all of the internal chambers 120. Whether the tracer compound, corrosive compound, and one or more different chemical components are mixed or housed in the same compartment or not, the ratio between the tracer compound and corrosive compound is about 1:1 (less corrosive) to 1:3 (more corrosive). The tracer compound, corrosive compound, and, if present, one or more different chemical compounds can be packaged together in the same pill, packet, pod, or bag without interacting or reacting with each other to affect each compound's performance or activity. In a plug and perf well, a number of frac plugs, for example, from 1 to 85, from 5 to 80, from 10 to 75, from 15 to 70, from 20 to 65, from 25 to 60, from 30 to 55, from 35 to 50, from 40 to 45 frac plugs may set inside the well at different depths, thereby creating multiple fracturing stages. Alternatively, plug and perf wells can have more than 85 plugs or more than 100 plugs per well. Each frag plug 100 is delivered into a wellbore wherein water or other wellbore fluids are present downstream of the plug. Each frac plug 100 may thus hold a different kind of the tracer or dye compound to facilitate identification of each frac plug. Once a portion or portions of the external wall 122 of the frac plug 100 is dissolved by water or other wellbore fluids after a period of time to allow wellbore operations to take place, it will expose the tracer or dye compounds to the downhole environment, including the wellbore fluids. When wellbore fluids containing the tracer or dye compounds flow back to land surface, the end user will be able to monitor the released tracer or dye compounds from the water or other wellbore fluids. The tracer or dye compounds when released to the water or other wellbore fluids can be detected by, for example, analyzing fluid samples and identifying parts per million of the tracer or dye compounds using analyzing instruments. The end user then will be able to identify which frac plug dissolves and where the flow originates from due to different and unique chemical features of each tracer or dye compound. Each and every tracer compound is unique and can be identified through the fluid analysis. It is important to make sure to dissolve each frac plug not to have obstructions in the wellbore. If desired, multiple chambers of each tracer compound or even multiple chambers of different tracer compounds can be used. Each chamber's external wall may have a different size, thickness, composition, or other characteristic, thereby releasing different tracer or dye compounds at different times.

The internal chamber 120 further serves to house a compound that is caustic or corrosive to at least a dissolvable portion of the dissolvable frac plug 100. Herein, the terms "caustic" or "corrosive" as applied to the compound refer to a compound that is able to cause, promote, enhance, or accelerate the dissolution of another substance, whether alone or in combination with other compounds. Thus, the internal chamber 120 is configured to contain a corrosive compound capable of causing or accelerating the disintegration of at least a part of the dissolvable frac plug 100. The corrosive compound may come in any of a variety of forms. The compound may be a solid, liquid, or a gas, or any combination thereof, in various embodiments. Further, the corrosive compound may be able to react with a reactive portion of the dissolvable frac plug 100 by itself. This of course requires the design of the chamber 120 holding the corrosive material to have a sufficient thickness to retain the necessary strength for a period of time to allow wellbore operations to take place (e.g., 8-12 hours) before the plug 100 dissolves sufficiently to facilitate removal. In addition, the design of the internal chamber 120 and in particular, the thickness of the external wall 122 may reflect the possibility that the dissolvable frac plug 100 is immersed in enough water to start the dissolution of the external wall 122, as is the case in a typical wellbore.

Preferably, the corrosive compound is one that requires the addition of a different compound to gain the capability to rapidly degrade or increase the dissolution of the dissolvable frac plug 100. This can be achieved by providing different compounds in adjacent chambers such that the initial dissolution of the external wall 122 causes the compounds to be released where they can mix to form greater corrosivity and faster dissolution of the plug. For example, in some embodiments, one chamber may contain sodium bisulfate while another contains aluminum chloride, the mix of which may be more corrosive than each alone. Alternatively, the existing corrosive properties of a compound can be enhanced when the compound is combined with surrounding wellbore fluids. For example, a salt compound when released from the internal chamber combines with groundwater to form a solution that is much more corrosive than the salt itself. Further, multiple different compounds in different chambers (e.g., the sodium bisulfate, aluminum chloride, and others) may mix together with the downhole fluids to form more potent corrosive solutions to dissolve the plug 100 at a faster rate.

During operation of the dissolvable frac plug 100 in the wellbore, external surfaces of the dissolvable frac plug 100, and in particular, the dissolvable external wall 122 of the internal chamber 120, are exposed to downhole fluids such as water, brine, or injection fluids. The fluids may thus begin to degrade the external wall 122 during the operation of the dissolvable frac plug 100 at a relatively slow rate. In environments such as the Permian basin where downhole conditions may not be sufficiently corrosive, the dissolution of the dissolvable portions of the frag plug 100 may be minimal while the plug is deployed and operational. However, a size, thickness, composition, or other characteristic of the external wall 122 may be designed to time the degradation of the external wall 122 by the downhole fluids with the duration of deployment of the dissolvable plug 100. For example, the external wall may be sized to not be breached until after 8-12 hours to allow time for conventional fracking operations to be conducted. Accordingly, after operations involving the dissolvable frac plug 100 are completed, the downhole fluids breach the external wall 122 and cause the corrosive compound contained in the internal chamber 120 to and mix with the downhole fluids to form a new solution. The resulting mix of corrosive compound and downhole fluids exhibits corrosive properties that are significantly superior to that of the downhole fluids alone. As a result, the dissolution of the dissolvable frac plug 100 after the beach of the internal chamber 120 is accelerated by several hours. Further, the enhanced dissolution facilitates the removal of the dissolved frac plug from the wellbore.

The dissolvable frac plug 100 is sized to perform its various functions, such as isolating zones of the wellbore. Accordingly, an external diameter of the dissolvable plug 100 may be comparable to a diameter of a wellbore, for example. Further, a size of the dissolvable frac plug 100 may be a factor in the plug's dissolution time. For example, a smaller dissolvable frac plug 100 may dissolve faster than a larger plug for the same concentration of corrosive solution. The size of the dissolvable frac plug 100 may also affect the quantity of corrosive compound carried in the internal chamber 120, which in turn affects the dissolution time of the plug 100. In light of these and other relevant factors, an exemplary dissolvable frac plug 100 may weight about 10 lbs., and have a length of about 13.82 inches, with an internal diameter for the mandrel core 101 of about 2 inches, and an external diameter for the plug of about 4.25 inches, in some embodiments. It should be noted that other dimensions for the dissolvable frac plug 100 are possible depending on properties of the plug (e.g., dissolution time, weight, etc.) are balanced or prioritized in its design.

Various combinations of the dissolvable material of the frac plug 100 and the corrosive compound may be used. For example, a dissolvable portion of a frag plug 100 may be composed of a material that is degradable when exposed to a high basicity (or high pH) compound. In some embodiments, the dissolvable frag plug material may be reactive with a high acidity (low pH) compound. In other embodiments, a property of the dissolvable frac plug material and the corrosive compound other than the pH scale may precipitate their reaction and cause the dissolution a portion of the frac plug 100. In embodiments where the dissolvable frac plug 100 or portion of the frac plug 100 is made of a magnesium or aluminum alloy, the corrosive compound may comprise a compound that forms an acidic solution when mixed with downhole fluids. The use of a compound that becomes corrosive only when mixed with downhole fluids alleviates the need to protect the internal chamber 120 from reacting with the compound (for example, with an internal coating), in order to guard against a premature dissolution from inside the internal chamber 120.

In a preferred embodiment, the corrosive compound comprises sodium bisulfate, also known sodium hydrogen bisulfate or sodium acid sulfate ($NaHSO_4$). Sodium bisulfate is an acidic salt often used to create acidic solutions when mixed with one or more solvents such as water. The acidic salt comes in the form of a powder or similar granular structure. However, other suitable compounds have may different structures, such as one or more solid blocks of material that may dissolve upon contact with downhole fluids. The resulting acidic solution degrades the magnesium or aluminum alloys of the dissolvable plug 100 at a faster rate than water alone or any of the low acidity downhole fluids circulating in the wellbore. Various quantities of sodium sulfate may be suitable depending on the size of the frac plug 100, the downhole conditions, and other operational factors. For example, at a site where the downhole fluids have a relative elevated salinity, acidity, and/or temperature, a smaller quantity of sodium bisulfate may be sufficient to enhance the dissolution of the frac plug 100. In some embodiments, the amount of sodium bisulfate to be used is preferably about three times the volume of the dissolvable portion of the frac plug. This ratio may provide an optimum rate and degree of dissolution, in some examples.

Aluminum chloride ($AlCl_3$) may also serve as a corrosive compound for the dissolvable plug 100, in some embodiments. As with sodium bisulfate, aluminum chloride can be packed inside the internal chamber 120 as a solid or granular compound or a powder that can form an acidic solution when mixed with downhole fluids to degrade the dissolvable plug 100. This can be mixed with the sodium bisulfate or provided in a different adjacent chamber. If desired, multiple chambers of each powder or even multiple chambers of different powders can be used. And as wellbores are typically flush with ground water, the release of the powder or powders creates an acidic, corrosive environment that more rapidly dissolves the plug than water alone.

Figure 2A:
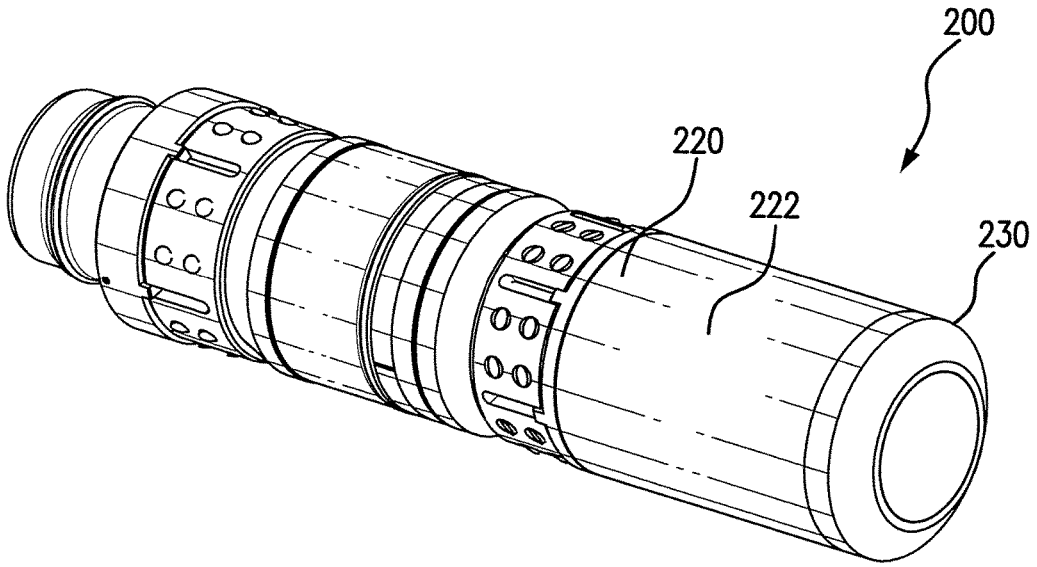
FIG. 2A illustrates a perspective view of a dissolvable frac plug comprising an internal chamber near or at the bottom portion of the plug, according to an embodiment consistent with the principles described herein.
Figure 2B:
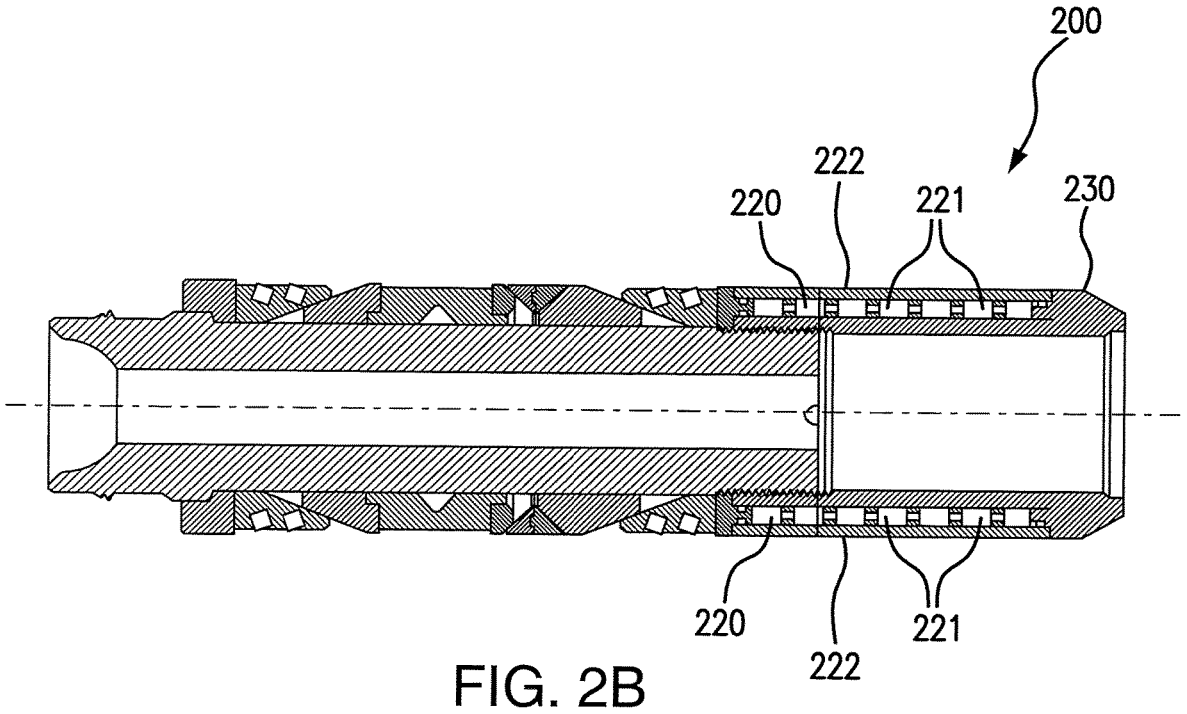
FIG. 2B illustrates a cross-sectional view of a dissolvable frac plug comprising an internal chamber near or at the bottom portion of the plug, according to an embodiment of the principles described herein.

FIG. 2A illustrates a perspective view of a dissolvable frac plug 200, according to another embodiment of the principles described herein. FIG. 2B illustrates a cross-sectional view of the dissolvable frac plug 200, according to an embodiment of the principles described herein. The dissolvable frac plug 200 is substantially similar in many respects to the dissolvable frac plug 100, previously described. For example, the dissolvable frac plug 200 comprises an internal chamber 220. The internal chamber 220 is configured to house one or more of tracer or dye compounds that may allow the end user to identify which frac plug dissolves and where the flow originates from due to its different chemical features. The internal chamber 220 is further configured to house a compound that may become corrosive or caustic to the dissolvable portions of the frac plug 200 when mixed with downhole fluids. However, the dissolvable frac plug 200 differs from the dissolvable frac plug 100 principally in the location and structure of the internal chamber 220. The internal chamber 220 of the frac plug 200 shares the same concentric cylindrical outer shape as that of the dissolvable frac plug 100. Unlike the dissolvable frac plug 100, the internal chamber 220 is located near the bottom end of the frac plug 200, and in particular, comprises the bottom cap 230 of the dissolvable frac plug 200. Further, unlike the internal chamber 120 of frac plug 100, the internal chamber 220 comprises a plurality of smaller chambers or sub-chambers 221 arranged in successive hollow rings concentrically formed around the mandrel core. The sub-chambers 221 may have different shapes in other embodiments. The internal chamber 220 comprising sub-chambers 221 is shielded from the well environment by an external wall 222 that is exposed to downhole fluids during the operation of the frac plug 200 and formed with a dissolvable material. The downhole conditions may dissolve the external wall 220 during the operation of the frac plug 200, permitting the tracer or dye compounds in the internal chamber 220 to be released into the downhole fluids and flow back to land surface, updating the status of dissolution of plugs for each stage. The dissolution of the external wall 220 also permits to form a corrosive solution to degrade the remains of the frac plug 200. Internal walls between the smaller chambers 221 of the internal chamber 220 may also be dissolved during this process, in some embodiments. Also, the different chambers can contain the same compound or different compounds that combine when released to form a more corrosive environment around and adjacent the plug.

Figure 3A:
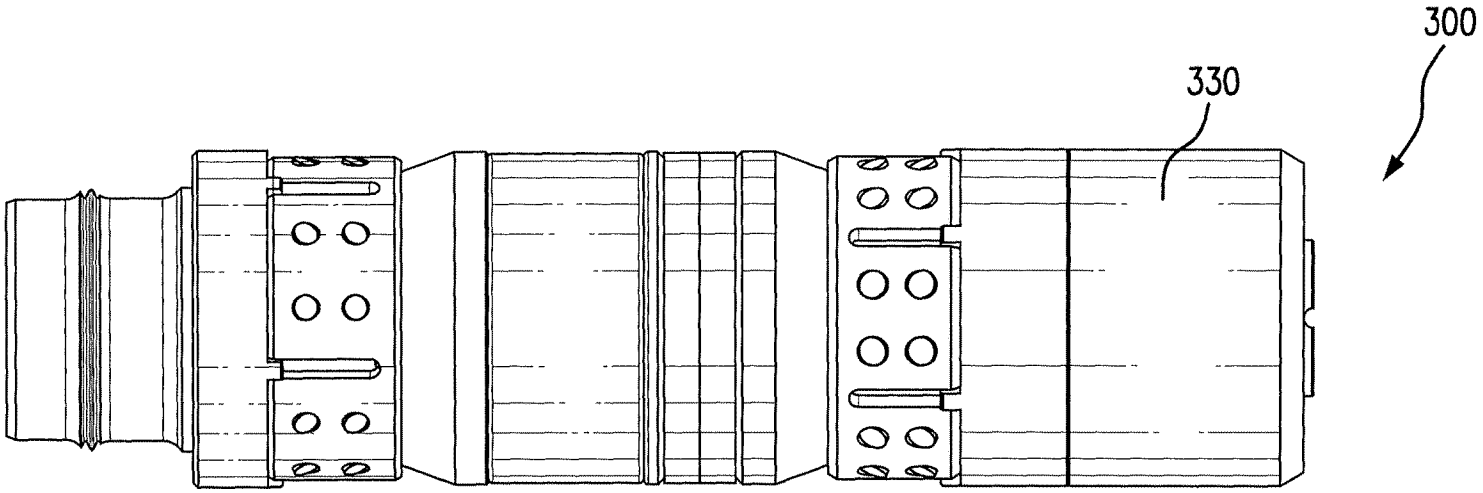
FIG. 3A illustrates a perspective view of a dissolvable frac plug comprising an internal chamber inside a bottom cap of the plug, according to an embodiment consistent with the principles described herein.
Figure 3B:
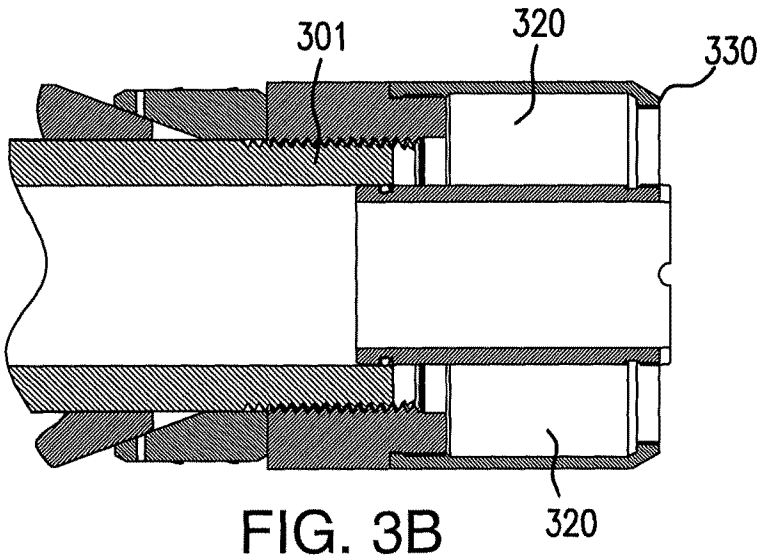
FIG. 3B illustrates a cross-sectional view of a dissolvable frac plug comprising an internal chamber inside a bottom cap of the plug, according to an embodiment consistent with the principles described herein.

FIG. 3A illustrates a perspective view of a dissolvable frac plug 300, according an embodiment of consistent with principles described herein. FIG. 3B illustrates a cross sectional view of the bottom end of the dissolvable frac plug 300 comprising a bottom cap 330, according to an embodiment consistent with the principles herein. The dissolvable frac plug 300 has a generally elongated shape similar to the dissolvable frac plugs 100 and 200, previously described. As with the dissolvable frac plug 200, the internal chamber 320 is located in a bottom cap 330 secured to the bottom end of the frac plug 300. However, in the dissolvable frac plug 300, a single internal chamber 320 is featured in the bottom cap 330, unlike the multiple sub-chambers 221 of the dissolvable frac plug 200. The single internal chamber simplifies and facilitates the manufacture and construction of frac plug 300. Like the internal chambers 120 and 220 as shown above, the internal chamber 320 is configured to house tracer material, corrosive compounds, and/or one or more different chemical compounds.

Figure 4A:
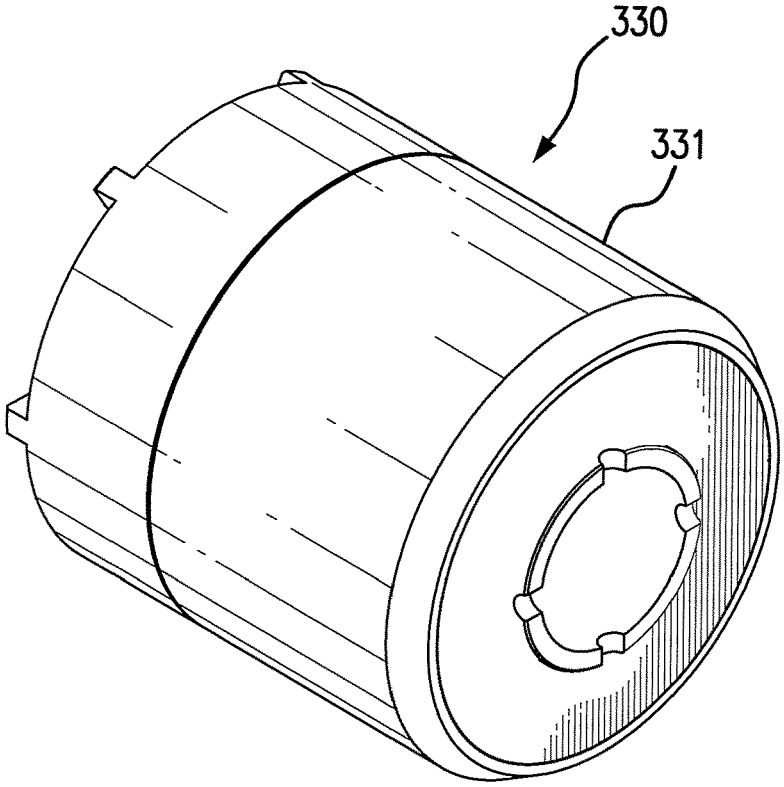
FIG. 4A illustrates a perspective view of a bottom cap of a dissolvable frac plug comprising an internal chamber, according to an embodiment consistent with the principles described herein.
Figure 4B:
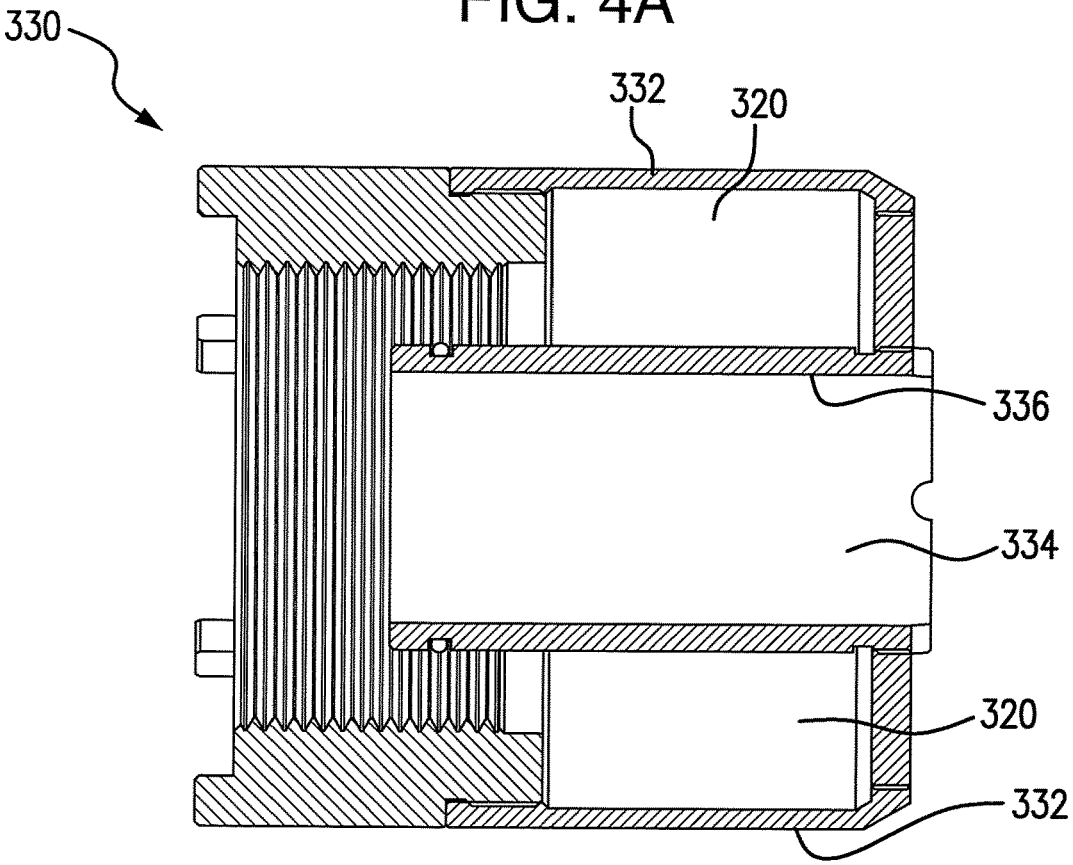
FIG. 4B illustrates a cross-sectional view of a bottom cap of a dissolvable frac plug comprising an internal chamber, according to an embodiment consistent with the principles described herein.

FIG. 4A illustrates a perspective view of a bottom cap 330, according to an embodiment consistent with the principles described herein. FIG. 4B illustrates a cross-sectional view of a bottom cap 330, according to an embodiment consistent with the principles described herein. The bottom cap 330 comprises a cylindrical housing 331 having a threaded inner surface adjacent the upper part of the bottom cap 330. The threaded inner surface of the bottom cap 330 is configured to cooperate with complimentary threads on an outer surface of the mandrel 301 to secure the bottom cap 330 to the mandrel 301. If desired, the threaded disconnect feature on the housing can also be made of dissolvable material. The bottom cap 330 may be attached to the mandrel 301 with other means, in some embodiments. For example, the bottom cap 330 may be welded to the mandrel 301 or integrally formed with it, in some examples. The internal chamber 320 of the bottom cap may have a cylindrical shape that is concentric to a central axis of the bottom cap 330. The internal chamber 320 is separated from the axial bore 334 of the bottom cap 330 by an inner wall 336. An external wall 332 may also separate the internal chamber 320 from the outer surface of the dissolvable frac plug 300 or bottom cap 330, and the downhole environment.

Figure 5A:
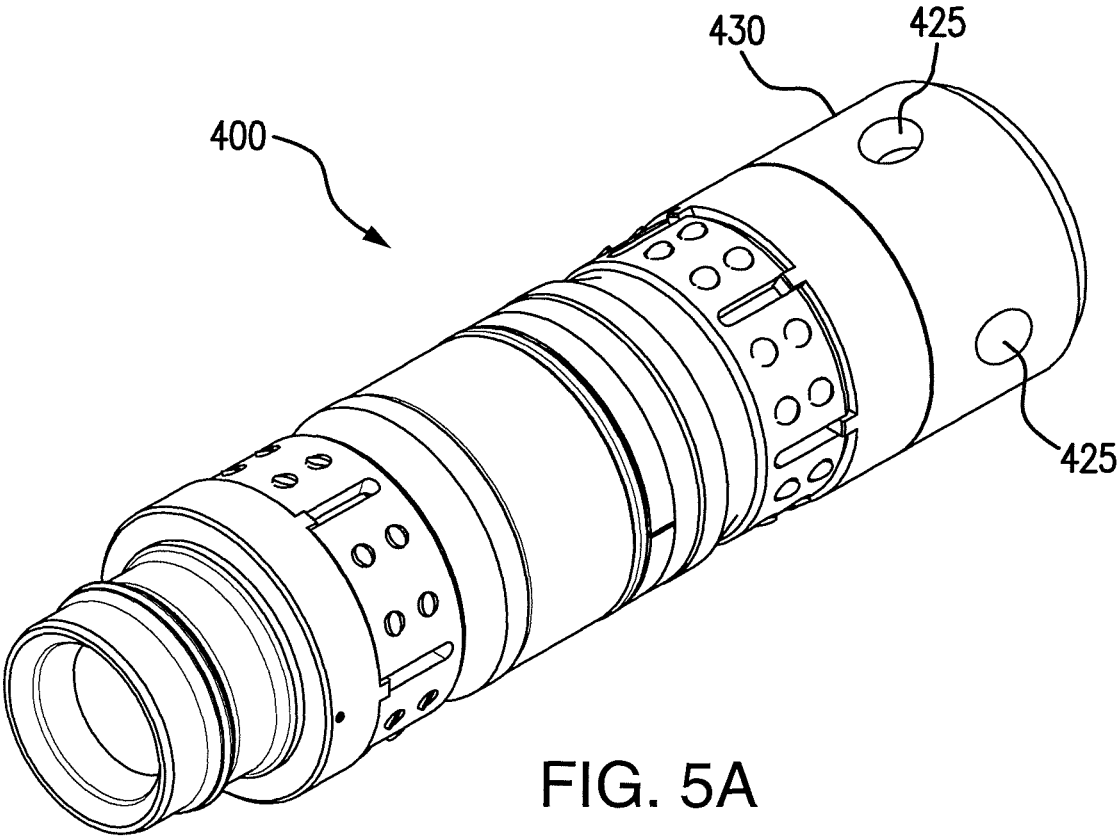
FIG. 5A illustrates a perspective view of a dissolvable frac plug comprising one or more openings in an external wall of the plug, according to an embodiment consistent with the principles described herein.
Figure 5B:
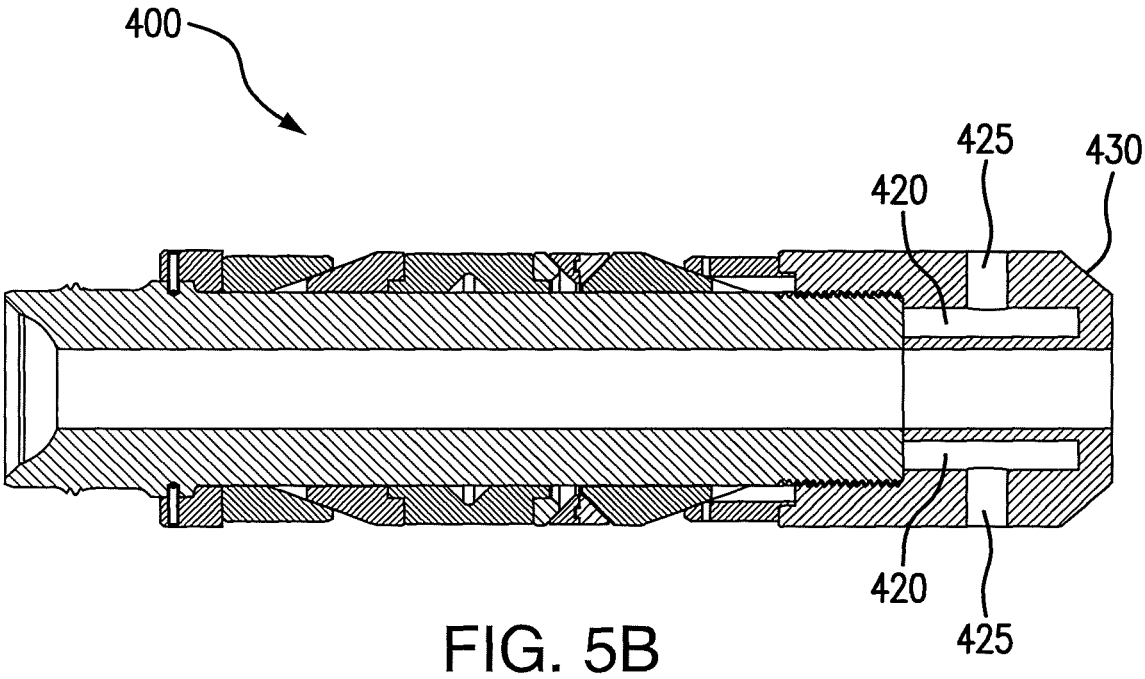
FIG. 5B illustrates a cross-sectional view of a dissolvable frac plug comprising one or more openings in an external wall of the plug, according to an embodiment consistent with the principles described herein.

FIG. 5A illustrates a perspective view of a dissolvable frac plug 400, according an embodiment of consistent with principles described herein. FIG. 5B illustrates a cross sectional view of a dissolvable frac plug 400, according to an embodiment consistent with the principles herein. The dissolvable frac plug 400 has a generally elongated shape similar to the dissolvable frac plugs 100, 200, and 300, previously described. As with the dissolvable frac plugs 200 and 300, the internal chamber 420 is located in a bottom cap 430 secured to the bottom end of the frac plug 400. However, in the dissolvable frac plug 400, an external wall 432 of the dissolvable frac plug 400 includes one or more openings 425 linking the internal chamber 420 to the exterior of the dissolvable frac plug 400.

Figure 6A:
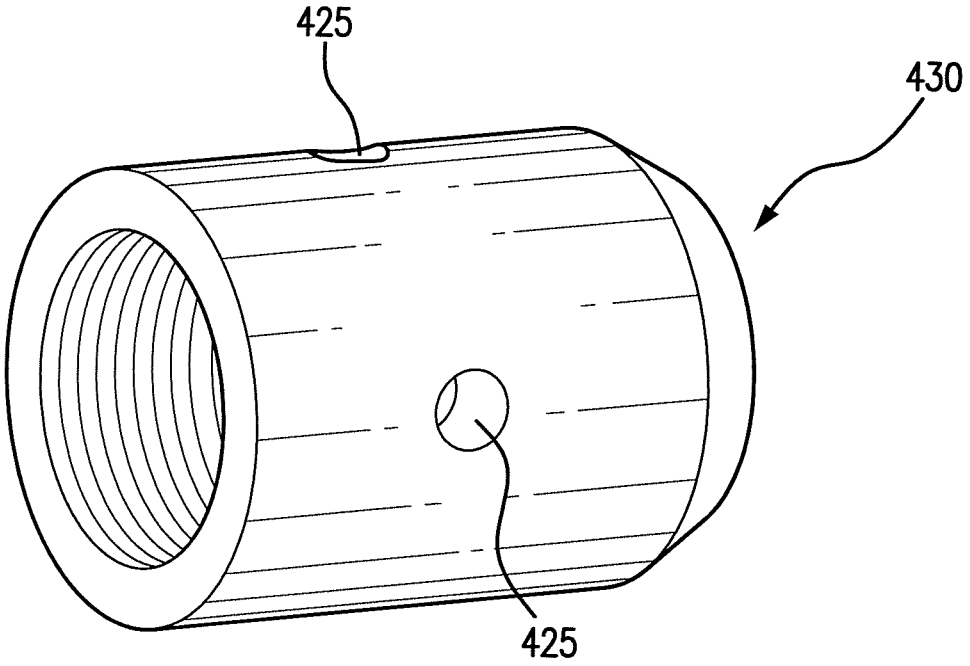
FIG. 6A illustrates a perspective view of a bottom cap of a frac dissolvable plug comprising one or more openings to the internal chamber in the external wall of the bottom cap, according to an embodiment consistent with the principles described herein.
Figure 6B:
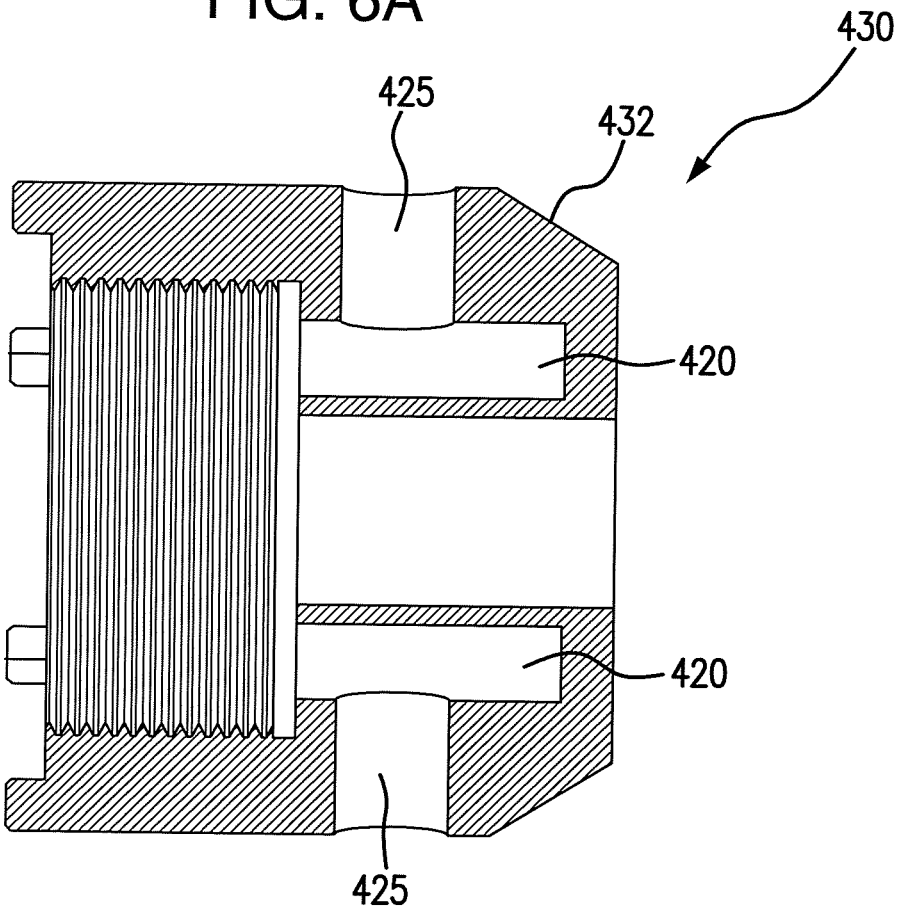
FIG. 6B illustrates a cross-sectional view of a bottom cap of a dissolvable frac plug comprising one or more openings to the internal chamber in the external wall of the bottom cap, according to an embodiment consistent with the principles described herein.

FIG. 6A illustrates a perspective view of a bottom cap 430 having one or more openings 425, according to an embodiment consistent with the principles described herein. FIG. 6B illustrates a cross-sectional view of the bottom cap 430 having one or more openings 425, according to an embodiment consistent with the principles described herein. The bottom cap 430 of the dissolvable frac plug 400 is similar in many respects to the bottom cap 330 of the dissolvable plug 300. In addition, the external wall 432 of the bottom cap 430 may include one or more openings 425 linking the internal chamber 420 to the exterior of the dissolvable frac plug 400. The one or more openings 425 provide access to the internal chamber 420 for filling the chamber with the tracer material, corrosive material (e.g., sodium bisulfate), and/or other chemical compounds before the deployment of the dissolvable frac plug 400. The external wall 432 may comprise any number of openings 425. Further, after the tracer material, corrosive material, and/or other chemical compounds are inserted in the internal chamber 420, the openings 425 of the internal chamber 420 may be closed with a curable compound that seals the internal chamber 420 and prevent escape of the tracer material, corrosive compounds, and/or other chemical compounds. For example, the openings 425 of the internal chamber 420 may be sealed with epoxy or similar polymer, or any other substance that minimally reacts to the sealed acid and downhole fluids. The openings 425 to the internal chamber 420 are only illustrated in FIGS. 5A-5B and 6A-6B with respect to the internal chamber 420 inside the bottom cap 430 of the dissolvable frac plug 400. However, the internal chambers 120 and 220 of the dissolvable frac plugs 100 and 200 which are located along the mandrels 101 and 201 may also feature similar openings. In some embodiments, these openings in the internal chambers 120 and 220 of the dissolvable frac plugs 100 and 200 may also be sealed with epoxy or similar curable compound to secure the tracer material, corrosive compound inside and/or other chemical compounds.

In a preferred embodiment, multiple dissolvable frac plugs such as 100, 200, 300 or 400, for example, from 1 to 85, from 5 to 80, from 10 to 75, from 15 to 70, from 20 to 65, from 25 to 60, from 30 to 55, from 35 to 50, from 40 to 45 dissolvable frac plugs can be provided, each of the dissolvable plugs containing a different kind of tracer or dye compound to be released to water or other wellbore fluids and flow back to land surface, which allows the end user on the surface to identify which frac plug dissolves and where the flow originates from due to different and unique chemical features of the tracer compounds.

It should be understood that combinations of described features or steps are contemplated even if they are not described directly together or not in the same context.

It should be understood that claims that include fewer limitations, broader claims, such as claims without requiring a certain feature or process step in the appended claim or in the specification, clarifications to the claim elements, different combinations, and alternative implementations based on the specification, or different uses, are also contemplated by the embodiments of the present invention.

The term "about" herein specifically includes ±10% from the indicated values in the range.

Other terms or words that are used herein are directed to those of ordinary skill in the art in this field of technology and the meaning of those terms or words will be understood from terminology used in that field or can be reasonably interpreted based on the plain English meaning of the words in conjunction with knowledge in this field of technology. This includes an understanding of implicit features that for example may involve multiple possibilities, but to a person of ordinary skill in the art a reasonable or primary understanding or meaning is understood.

It should be understood that the above-described examples are merely illustrative of some of the many specific examples that represent the principles described herein. Clearly, those skilled in the art can readily devise numerous other arrangements without departing from the scope as defined by the following claims.

What is claimed is:

1. A dissolvable frac plug comprising:

a flowbore running through a mandrel;

at least one internal chamber within the mandrel surrounded by an external wall and an internal wall, wherein the internal wall is positioned radially adjacent to the flowbore, and the internal wall is not initially exposed to an annulus outside of the dissolvable frac plug and the external wall is exposed to the annulus;

a chemical compound positioned within the at least one internal chamber in an amount sufficient to be observed from water or other wellbore fluids; and an opening within the external wall, wherein the opening is configured to allow the chemical compound to be positioned within the at least one internal chamber.

2. The dissolvable frac plug of claim 1, wherein the internal chamber further includes:

a corrosive compound;

wherein a portion or portions of the external wall are configured to dissolve due to contact with water or other wellbore fluids in the annulus to release the chemical compound to the fluids, wherein the chemical compound is exposed when the portion or portions of the external wall are dissolved, the annulus being positioned radially between an outer diameter of the external wall and a wellbore wall, wherein the flowbore extends from a proximal end of the mandrel to a distal end of the mandrel; and a curable compound that is configured to close the opening after the chemical compound is positioned within the at least one internal chamber.

3. The dissolvable frac plug of claim 1, wherein the internal chamber comprises:

one or more cylindrical chambers that surround the dissolvable frac plug.

4. The dissolvable frac plug of claim 1, wherein the external wall includes one or more openings to allow filling or packing of the at least one internal chamber with the chemical compound, a dry powder and, if present, other chemical compounds.

5. The dissolvable frac plug of claim 4, wherein the one or more openings are closed by a curable compound that seals the internal chamber and prevents escape of the chemical compound, the dry powder and, if present, the other chemical compounds.

6. The dissolvable frac plug of claim 4, wherein the dry powder is sodium bisulfate and the external wall is made of a dissolvable aluminum or magnesium metal or alloy.

7. The dissolvable frac plug of claim 4, wherein the dry powder is aluminum chloride and the external wall is made of a dissolvable aluminum or magnesium metal or alloy.

8. The dissolvable frac plug of claim 1, wherein the chemical compound is in a form of powder.

9. The dissolvable frac plug of claim 1, wherein the chemical compound comprises:

an oil soluble tracer including a halogenated hydrocarbon.

10. The dissolvable frac plug of claim 9, wherein the halogenated hydrocarbon comprises fluorobenzoate, chlorobenzoate, bromobenzene, or a mixture thereof.

11. The dissolvable frac plug of claim 1, wherein the chemical compound comprises:

a water soluble tracer comprising a halogenated salt.

12. The dissolvable frac plug of claim 11, wherein the halogenated salt includes sulfonic acid, fluorobenzoic acid, chlorobenzoic acid, or a mixture thereof.

13. The dissolvable frac plug of claim 1, wherein the chemical compound comprises a gas soluble tracer comprising a perfluorinated compound.

14. The dissolvable frac plug of claim 13, wherein the perfluorinated compound includes mercaptan, nitrogen, perfluoromethylcyclopentane, perfluoromethylcyclohexane, or a mixture thereof.

15. The dissolvable frac plug of claim 1, further comprising:

dissolvable frac plugs, each of the dissolvable frac plugs containing a different kind of chemical compound.

16. The dissolvable frac plug of claim 15, wherein the number of dissolvable frac plugs is between 35 and 50.

17. The dissolvable frac plug of claim 1, wherein the external wall is configured to dissolve in contact with water or other wellbore fluids within eight hours to twelve hours before releasing the chemical compound.

18. A method of tracking dissolution of a dissolved frac plug, which comprises:

providing a dissolvable frac plug including at least one internal chamber within a mandrel surrounded by an external wall with a chemical compound positioned in the at least one internal chamber in an amount sufficient to be observed from water or other wellbore fluids;

positioning the chemical compound within the at least one internal chamber via an opening within the external wall; wherein an internal wall is not initially exposed to an annulus outside of the dissolvable frac plug and the external wall is exposed to the annulus;

flowing fluid through a flowbore running through the mandrel, wherein the at least one internal chamber is positioned radially adjacent to the flowbore, the external wall being positioned within an outer diameter of the mandrel;

delivering the dissolvable frac plug into a wellbore wherein water or other wellbore fluids are present downstream of the plug; and identifying the chemical compound from the water or other wellbore fluids.

19. The method of claim 18, including:

dissolving a portion or portions of the external wall;

exposing at least a portion of the internal chamber for release of the chemical compound to the water or other wellbore fluids;

positioning a corrosive compound within the internal chamber, wherein a portion or portions of the external wall are configured to dissolve due to contact with water or other wellbore fluids to release the chemical compound to the fluids, wherein the chemical compound is exposed when the portion or portions of the external wall are dissolved; and closing the opening via a curable compound after the chemical compound is positioned within the internal chamber.

* * * * *